US010755659B2

(12) United States Patent
Chen

(10) Patent No.: US 10,755,659 B2
(45) Date of Patent: Aug. 25, 2020

(54) DRIVE CIRCUIT, DRIVE METHOD OF DRIVE CIRCUIT AND DISPLAY DEVICE

(71) Applicants: HKC Corporation Limited, Baoan Dist, Shenzhen (CN); Chongqing HKC Optoelectronics Technology Co., Ltd., Chongqing (CN)

(72) Inventor: Yu-Jen Chen, Chongqing (CN)

(73) Assignees: HKC Corporation Limited, Shenzhen (CN); Chongqing HKC Optoelectronics Technology Co., Ltd., Chongqing (CN)

( * ) Notice: Subject to any disclaimer, the term of this patent is extended or adjusted under 35 U.S.C. 154(b) by 0 days.

(21) Appl. No.: 15/744,828

(22) PCT Filed: Jun. 16, 2017

(86) PCT No.: PCT/CN2017/088740
§ 371 (c)(1),
(2) Date: Jan. 15, 2018

(87) PCT Pub. No.: WO2018/205349
PCT Pub. Date: Nov. 15, 2018

(65) Prior Publication Data

US 2020/0058260 A1 Feb. 20, 2020

(30) Foreign Application Priority Data

May 11, 2017 (CN) ..... 2017 1 0329014

(51) Int. Cl.
*G09G 3/36* (2006.01)

(52) U.S. Cl.
CPC ..... *G09G 3/3677* (2013.01); *G09G 3/3696* (2013.01)

(58) Field of Classification Search
None
See application file for complete search history.

(56) References Cited

U.S. PATENT DOCUMENTS

2011/0018846 A1* 1/2011 Hu ..... G02F 1/136286 345/204
2017/0169788 A1* 6/2017 Kim ..... G09G 3/3677

* cited by examiner

*Primary Examiner* — Christopher J Kohlman
(74) *Attorney, Agent, or Firm* — Wang Law Firm, Inc.

(57) ABSTRACT

A drive circuit, a drive method of the drive circuit and a display device are provided. The drive circuit includes a signal output module, a first level signal output end; and a plurality of switch modules. The signal output module includes N output ends for outputting a gate drive signal step by step to N scan lines. The switch modules each correspond to one of the scan lines. A control end of the i-th switch module is electrically connected with the i−1th scan line. A first connecting end is electrically connected with the corresponding i-th scan line. A second connecting end is electrically connected with the first level signal output end. Wherein, N is a positive integer, and i is a positive integer greater or less or equal to N.

12 Claims, 9 Drawing Sheets

DRIVE CIRCUIT, DRIVE METHOD OF DRIVE CIRCUIT AND DISPLAY DEVICE

CROSS-REFERENCE TO RELATED APPLICATION

This application claims the benefit of China Patent Application No. 201710329014.1, filed on May 11, 2017, in the State Intellectual Property Office of the People's Republic of China, the disclosure of which is incorporated herein in its entirety by reference.

FIELD OF THE INVENTION

The present invention relates to the display drive technology, and more particularly to a drive circuit, a drive method of the drive circuit and a display device.

BACKGROUND OF THE INVENTION

A thin film transistor liquid crystal display (TFT-LCD) is one of panel displays on the market, and it has become an important display platform of modern IT and video products. The drive principle of the TFT-LCD is that a system board of the display transmits an R/G/B compression signal and a control signal to a connector of a printed circuit board (PCB) through the wiring. After the data signal and the control signal are processed by a timing controller of the printed circuit board, the data signal and the control signal are transmitted to a display area of the display through a source-chip on film (S-COF) and a gate-chip on film (G-COF), so that data lines and scan lines of the display area of the LCD obtain the required data signals and gate drive signals, respectively.

In practical applications, during the process of charging, the pixels of the display area of the TFT-LCD have the problem that the pixels are charged insufficiently. Because the resolution of the TFT-LCD product is getting higher and higher, the corresponding scan lines will be more and more. Under the situation that the frame period is constant, the scan time of each scan line is too short, so that the charge time of the pixels is too short. The problem that the pixels are charged insufficiently results in poor contrast images and flickers.

In addition, the charge current of the pixels in the display area of the TFT-LCD is reduced by the temperature reduction. Since the moving speed of the conductive carrier of the TFT connecting the pixel electrode is slowed down with the temperature reduction, the conductive current of the TFT is reduced. This also causes the problem that the pixels are charged insufficiently results in poor contrast images and flickers.

SUMMARY OF THE INVENTION

The primary object of the present invention is to provide a drive circuit, a drive method of the drive circuit and a display device in order to solve the problem that the pixels of a display panel are charged insufficiently to result in poor contrast images and flickers.

According to one aspect of the present invention, a drive circuit is provided. The drive circuit includes a signal output module, a first level signal output end; and a plurality of switch modules. The signal output module includes N output ends for outputting a gate drive signal step by step to N scan lines. The switch modules each correspond to one of the scan lines. A control end of the i-th switch module is electrically connected with the i−1th scan line. A first connecting end is electrically connected with the corresponding i-th scan line. A second connecting end is electrically connected with the first level signal output end. Wherein, N is a positive integer, and i is a positive integer greater or less or equal to N.

According to another aspect of the present invention, a drive method of a drive circuit is provided. The drive method is suitable for the drive circuit of any one of the embodiments of the present invention. The drive method includes the following steps: a signal output module outputting a gate drive signal to N scan lines through N output ends step by step; wherein, when the signal output module outputs the gate drive signal to the i−1th scan line, the i−1th scan line enables the switch module corresponding to the i-th scan line to be turned on, and a first level signal is transmitted to the i-th scan line through the switch module, wherein N is a positive integer, and i is a positive integer greater than 1, less than 1 or equal to N.

According to a further aspect of the present invention, a display device is provided. The display device includes a display panel and the drive circuit of any one of the embodiments of the present invention.

According to the embodiments of the present invention, the drive circuit is provided with the plurality of switch modules on the basis of the signal output module. Each switch module corresponds to one of the scan lines for controlling the first level signal output end to be connected with or disconnected from the corresponding scan line. Each switch module is controlled to be turned on or off by the upper scan line. When the signal output module outputs the gate drive signal to the upper scan line, the TFTs of the upper row are turned on. When the data line charges up the pixels of the upper row, the current switch module is turned on so that the current scan line acquires the first level signal and the data line charges up the pixels of the current row. The drive circuit of the embodiment of the present invention also charges the pixels of the next row when the pixels of a certain row are charged, so that a longer charge time is obtained for the pixels of each row to solve the problem that the pixels of the display panel are charged insufficiently to result in poor contrast images and flickers.

BRIEF DESCRIPTION OF THE DRAWINGS

These and/or other aspects will become apparent and more readily appreciated from the following description of the embodiments, taken in conjunction with the accompanying drawings, in which.

DESCRIPTION OF THE PREFERRED EMBODIMENTS

Advantages and features of the inventive concept and methods of accomplishing the same may be understood more readily by reference to the following detailed description of embodiments and the accompanying drawings. The inventive concept may, however, be embodied in many different form and should not be construed as being limited to the embodiments set forth herein.

Figure 1:
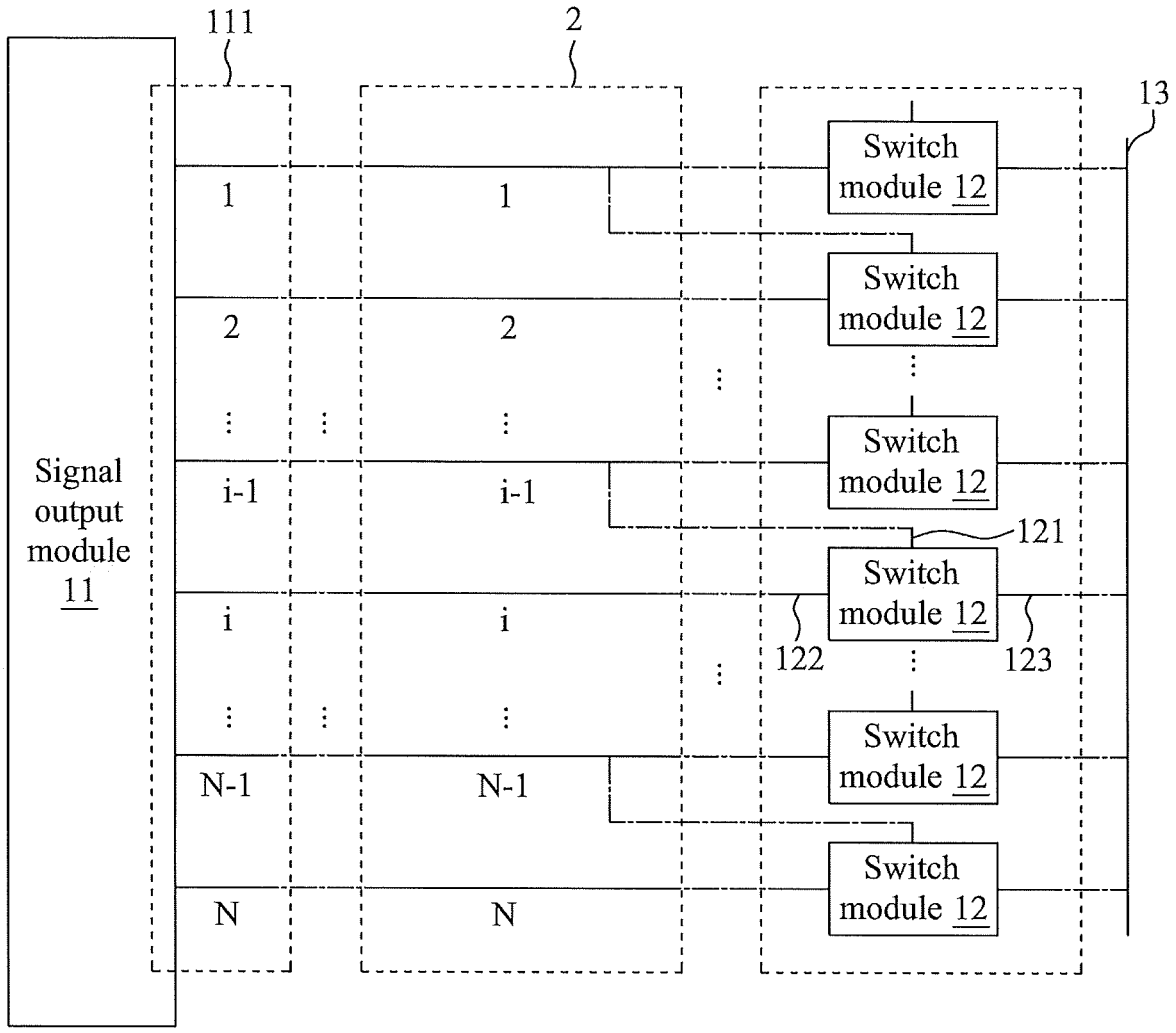
FIG. 1 is a schematic view of a drive circuit in accordance with an embodiment of the present invention.

FIG. 1 is a schematic view of a drive circuit in accordance with an embodiment of the present invention. The drive circuit includes a signal output module 11 and a plurality of switch modules 12.

The signal output module 11 includes N output ends 111 for outputting gate drive signals step by step to N scan lines 2.

Each of the switch modules 12 corresponds to a corresponding one of the scan lines 2. A control end 121 of each switch module 12 is electrically connected with the i−1th scan line 2. A first connecting end 122 is electrically connected with the corresponding i-th scan line 2. A second connecting end 123 is electrically connected with a first level signal output end 13 of the drive circuit. Wherein, N is a positive integer, and i is a positive integer greater or less or equal to N.

Figure 2:
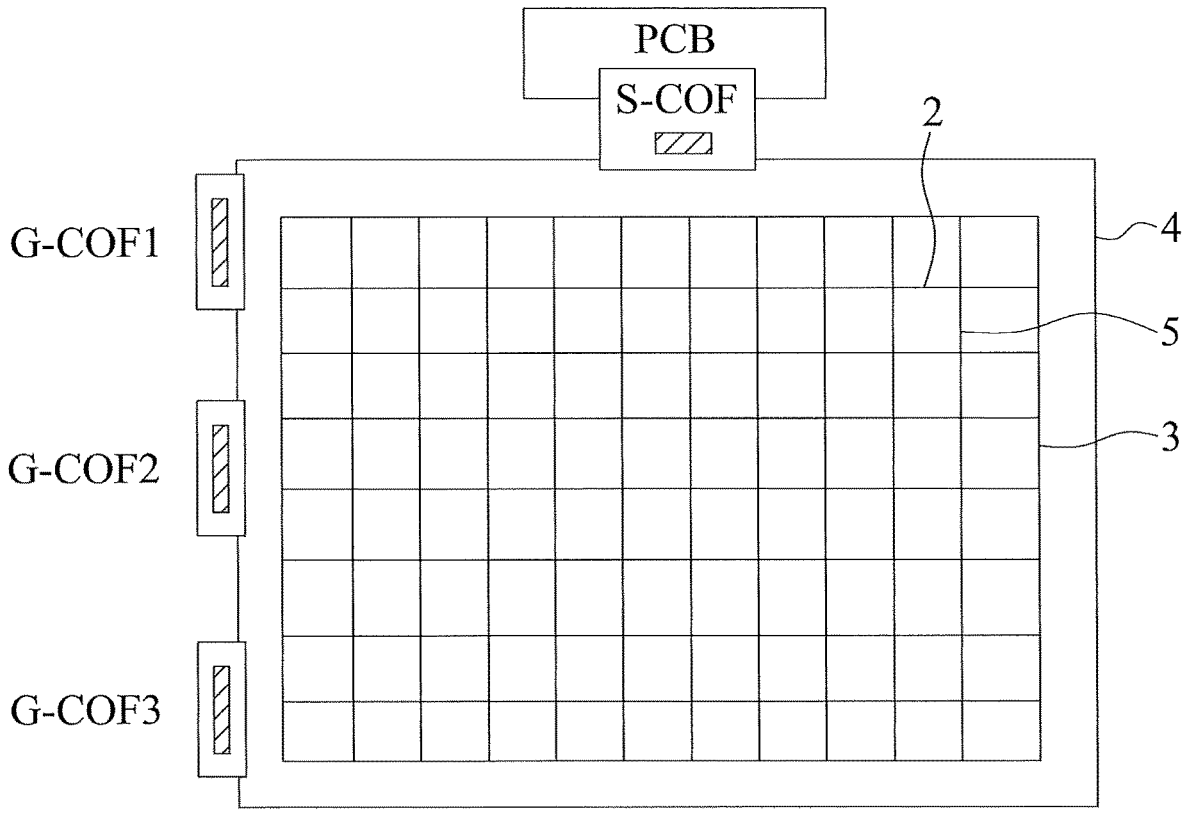
FIG. 2 is a schematic view of a drive structure of a thin film transistor liquid crystal display in accordance with an embodiment of the present invention.

In general, the display panel of a thin film transistor liquid crystal display is divided into a display area and a surrounding non-display area. FIG. 2 is a schematic view of a drive structure of a thin film transistor liquid crystal display in accordance with an embodiment of the present invention. The system board of the display transmits the R/G/B compression signal, the control signal and the power to the PCB through the wiring. After the aforesaid data signals are processed by the timing controller of the PCB board, the data signals are transmitted to a display area 3 of the display panel through S-COF. The data signals are transmitted to the display area 3 through G-COF. A non-display area 4 is disposed around the display area 3, i.e., a fan-out area. The wiring, test points, and the drive circuit may be provided in the non-display area 4, according to the needs. As shown in FIG. 2, the display area 3 is provided with a plurality of interlaced scan lines 2 and data lines 5. The interlaced region of the scan line 2 and the data line 5 serves as a pixel unit. The pixel unit uses a transistor as a pixel switch. The display drive principle is that each of the scan lines 2 sequentially sends out a gate drive signal to the gate of a row of TFTs. When the TFT is turned on, the data line charges up a storage capacitor of the pixel via the conductive TFT to write in a gray scale voltage. After the TFT is turned off, the gray scale voltage is maintained by the storage capacitor until the next time the TFT controlling the pixel is turned on to update the gray scale voltage again. The scan lines 11 will continuously turn on the TFTs of each row, and then update the gray scale voltage of the pixels by the data lines. The TFT-LCD constantly repeats the operation in this way to update the image.

As shown in FIG. 1, the drive circuit includes a signal output module 11. The signal output module 11 includes output ends 111 corresponding in number to scan lines 2. N output ends 111 sequentially output gate drive signals to N scan lines 2.

The drive circuit further includes a plurality of switch modules 12. Each of the switch modules 12 corresponds to one of the scan lines 2. As shown in FIG. 1, a first connecting end 122 of each switch module 12 is electrically connected with the corresponding scan line 2. A second connecting end 123 is electrically connected with a first level signal output end 13 of the drive circuit. When the switch module 12 is turned on, the voltage value of the corresponding scan line 2 rises to the first level, and the corresponding scan line 2 turns on a row of TFTs on the array substrate controlled, and the data line charges up the storage capacitor of the pixel via the actuated TFTs. The control end 121 of each switch module 12 is electrically connected with the upper scan line 2 of the corresponding scan line 2, and the corresponding scan line 2 is also charged to the first level by the upper scan line 2 through the switch module 12, that is, the row of TFTs controlled by the corresponding scan line 2 are turned on. As an exemplary explanation, when the i-th output end 111 outputs the gate drive signal to the i−1th scan line 2, the TFTs of the i-th row are turned on and the storage capacitors of the pixels of the i-th row are charged. Meanwhile, the i−1th scan line 2 enables the first level signal output end 13 to output the first level signal to the i-th scan line 2 through the switch module 12 to turn on the TFTs of the i-th row. The data line charges up the storage capacitors of the pixels of the i-th row. When the i-th output end 111 outputs the gate drive signal to the i-th scan line 2, the data line continues to charge up the storage capacitors of the pixels of the i-th row. Overall, the charge time for the pixels of the i-th row is increased.

According to the embodiment of the present invention, the drive circuit is provided with the plurality of switch modules 12 on the basis of the signal output module 11. Each switch module 12 corresponds to one of the scan lines 2 for controlling the first level signal output end 13 to be connected to or disconnected from the corresponding scan line 2. Each switch module 12 is controlled to be turned on or off by the upper scan line 2. When the signal output module 11 outputs the gate drive signal to the upper scan line 2, the TFTs of the upper row are turned on. When the data line charges up the pixels of the upper row, the current switch module 12 is turned on so that the current scan line 2 acquires the first level signal and the data line charges up the pixels of the current row. The drive circuit of the embodiment of the present invention also charges the pixels of the next row when the pixels of a certain row are charged, so that a longer charge time is obtained for the pixels of each row to solve the problem that the pixels of the display panel are charged insufficiently to result in poor contrast images and flickers.

Figure 3A:
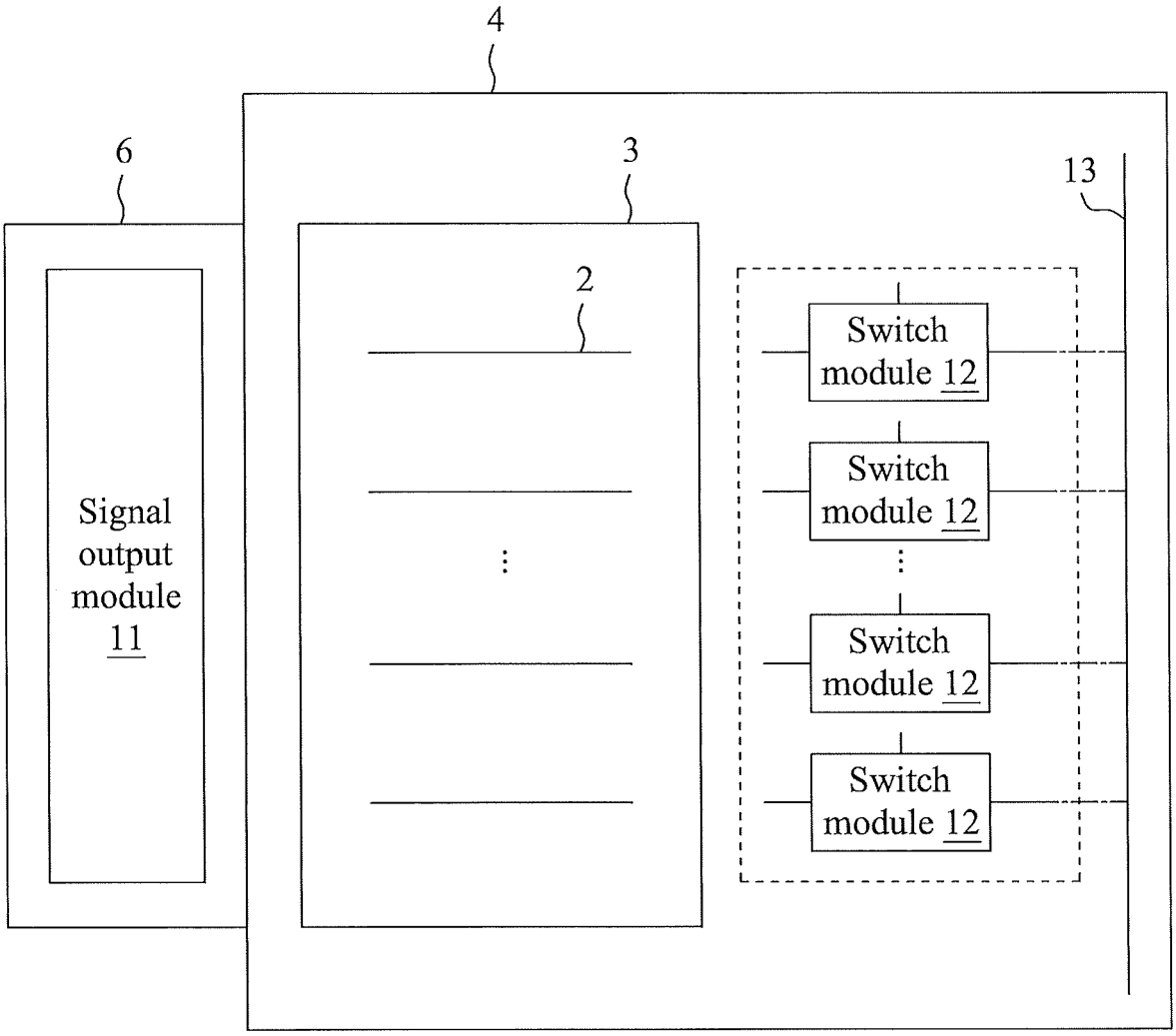
FIG. 3A is a schematic structural view of a display panel in accordance with an embodiment of the present invention. Based on the aforesaid embodiment.

FIG. 3A is a schematic structural view of a display panel in accordance with an embodiment of the present invention. Based on the aforesaid embodiment, the signal output module 11 is disposed on a gate-chip on film 5. The plurality of switch modules 12 are disposed on the non-display area 4 of the array substrate. In this embodiment, the switch modules 12 are disposed on the non-display region 4 by using the TFT process of the conventional array substrate. The setting process of the present invention is relatively simple as compared with the prior art. In the prior art, the corresponding functional pins of the gate-chip on film 5 must be set with a precharge function, and the output waveform of the gate-chip on film 5 is controlled by the timing controller. The design that the switch modules 12 are disposed on the non-display area 4 of the array substrate omits the internal logic circuit of the gate-chip on film 5 and the control signal of the timing controller, reducing the cost and enhancing the universality of the drive circuit of the present embodiment.

Selectively, referring to FIG. 3, the switch modules 12 are disposed on the non-display area 4 at the distal ends of the scan lines 2. The head ends of the scan lines 2 are electrically connected with the corresponding output ends of the signal output module 11, respectively. The switch modules 12 and the first level signal output ends 13 are disposed at the distal ends of the scan lines 2, respectively. The switch modules 12 are connected with the distal ends of the scan lines 2, respectively. The setting of the head ends of the scan lines 2 is the same as the conventional drive circuit. The head ends of the scan lines 2 are electrically connected with the corresponding output ends of the signal output module 11, respectively. The present invention only improves and modifies the non-display area 4 at the distal ends of the scan lines 2 on the basis of the conventional drive circuit. The process is simple and cost-effective.

Figure 3B:
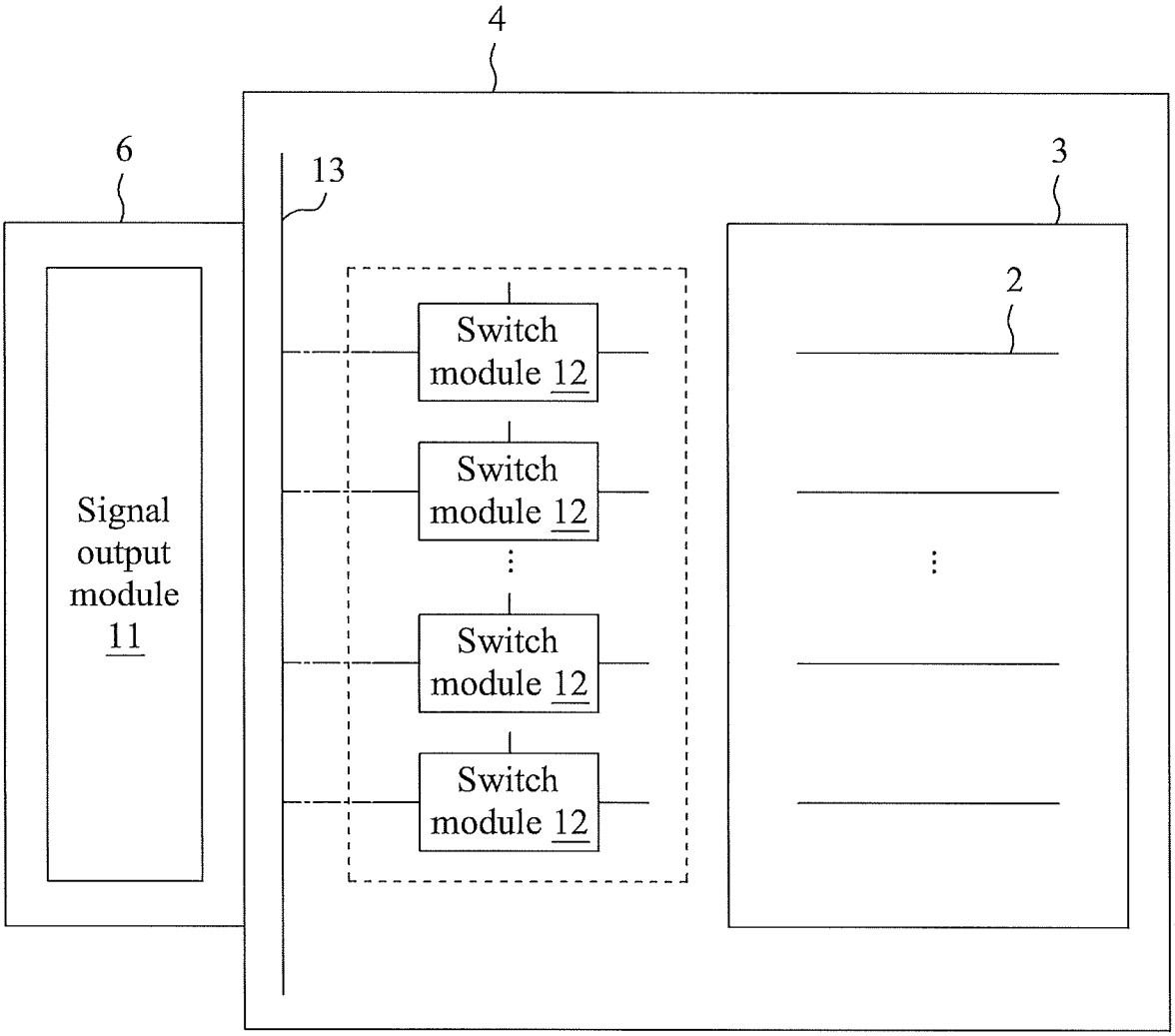
FIG. 3B is a schematic structural view of another display panel according to an embodiment of the present invention.

Similarly, FIG. 3B is a schematic structural view of another display panel according to an embodiment of the present invention. The switch modules 12 and the first level signal output ends 13 may be disposed on the non-display area 4 at the head ends of the scan lines 2. Both the signal output module 11 and the switch modules 12 are connected with the head ends of the scan lines 2. However, as to the structure shown in FIG. 3B, it is necessary to arrange multiple layers of wiring. The process is complicated as compared with the structure shown in FIG. 3A.

Selectively, the switch modules 12 are thin film transistors. In this embodiment, they may be N-type thin film transistors. The N-type thin film transistor is triggered by a high level so that the circuit of the TFT can be turned on in cooperation with the high level of the drive circuit, and the embodiment of the present invention is implemented. If the switch modules 12 are P-type transistors, P-type transistors are triggered by a low level. In the related art, the scan line 2 is at a high level to turn on the TFT. When one of the scan lines 2 is at a high level, the other scan lines 2 are at a low level. All the switch modules 12 controlled by the other scan lines 2 are turned on and the function of the display panel cannot be realized if the switch modules 12 are P-type transistors triggered by the low level. Therefore, if the switch modules 12 are P-type transistors, the structures of TFTs and the drive circuit in the array substrate need to be changed. The cost is wasted. In this embodiment, the switch modules 12 are N-type thin film transistors so that this problem can be solved.

Figure 4A:
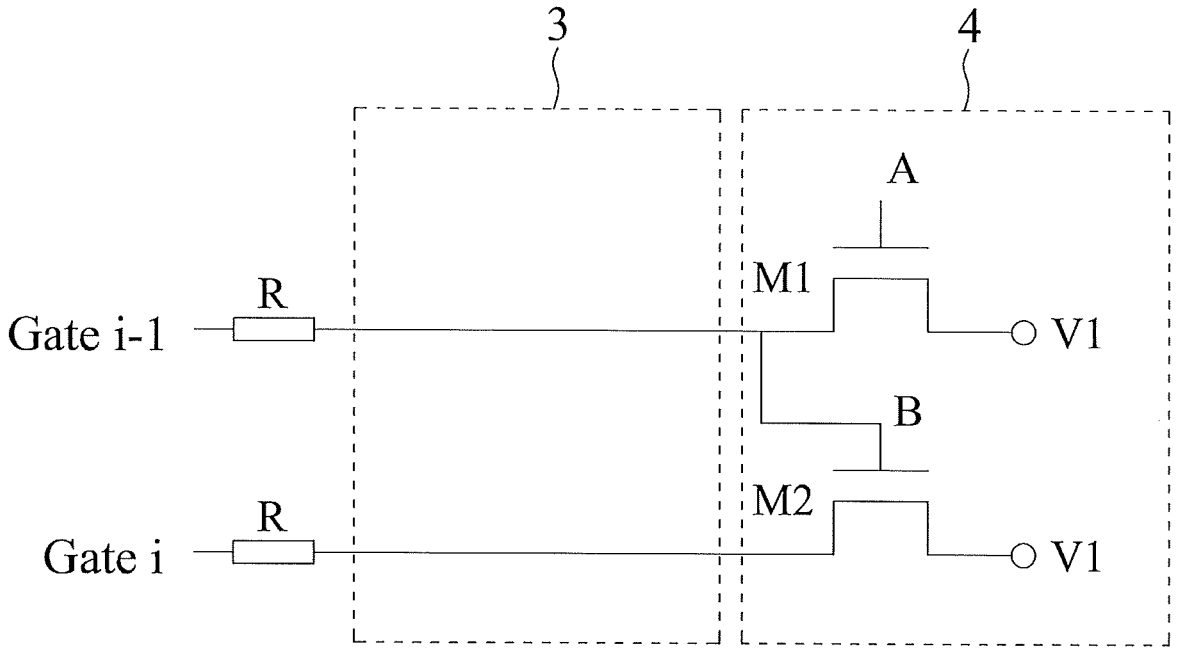
FIG. 4A is a schematic view of a partial structure of a drive circuit in accordance with an embodiment of the present invention.

FIG. 4A is a schematic view of a partial structure of a drive circuit in accordance with an embodiment of the present invention. Selectively, the voltage value of the gate drive signal is greater than the actuation voltage value of the control end of the N-type thin film transistor, and the actuation voltage value of the control end of the N-type thin film transistor is greater than the voltage value of the first level signal.

The voltage value of the gate drive signal is greater than the actuation voltage value of the control end of the N-type thin film transistor. The gate drive signal can be used to drive the N-type thin film transistor, so the voltage value of the gate drive signal must be greater than the actuation voltage of the control end of the N-type thin film transistor. Referring to FIG. 4A, when the N-type thin film transistor M1 in the display region 4 is turned on by the control end A, the voltage value of the scan line Gate i−1 is V1, and the N-type thin film transistor M2 corresponding to the scan line Gate i is not turned on by the voltage V1 to avoid the problem that the image is not displayed. The actuation voltage value of the control end of the N-type thin film transistor is required to be greater than the voltage value of the first level signal.

The voltage value of the gate drive signal is set as $V_{on}$, the actuation voltage valve of the control end of the N-type thin film transistor is set as $V_0$, and the voltage value of the first level signal is seat as $V_1$, and $V_{on}>V_0>V_1$. Selectively, the actuation voltage valve of the control end of the N-type thin film transistor may be set to 90% of the voltage value of the gate drive signal, and the voltage value of the first level signal is 80% of the voltage value of the gate drive signal, so that $V_{on}$, $V_0$ and $V_1$ are not too close and the N-type thin film transistors won't be triggered wrongly.

Selectively, the switch modules 12 are N-type metal-oxide semiconductor field-effect transistors. In the process of the conventional liquid crystal display panel, the TFT of the pixel electrode is the process of the N-type metal-oxide semiconductor field-effect transistor. The switch modules 12 are N-type metal-oxide semiconductor field-effect transistors, which can share the existing process of the liquid crystal display panel to save the cost.

Selectively, the voltage value of the gate drive signal is 30 V, the actuation voltage value of the control end of the N-type metal-oxide semiconductor field-effect transistor is 27 V, and the voltage value of the first level signal is 24 V. That is, $V_{on}$=30V, $V_0$=27V, $V_1$=24V.

Referring to FIG. 4A, when the upper scan line of the scan line Gate i−1 is at a high level, that is, 30V, the scan line Gate i−1 is at a low level, that is, the voltage value is zero. The N-type metal-oxide semiconductor field-effect transistor M1 is turned on by the upper scan line of the scan line Gate i−1 under the action of the high level. The voltage value of the scan line Gate i−1 on the corresponding display area 3 is the voltage value 24 V of the first level signal. The voltage value 24 V is less than the actuation voltage value of the N-type metal-oxide semiconductor field-effect transistor M2, so M2 cannot be turned on and the voltage value of the scan line Gate i is zero.

When the scan line Gate i−1 is at a high level of 30V, the other scan lines including Gate i are at a low lever. The gate voltage of M2 is 30V greater than the gate actuation voltage 27V of M2, so M2 is turned on. The voltage value of the scan line Gate i on the corresponding display area 3 is the voltage value 24 V of the first level signal. Similarly, the voltage value 24 V is not enough to turn on the next N-type metal-oxide semiconductor field-effect transistor. The voltage value of the next scan line is zero.

Figure 4B:
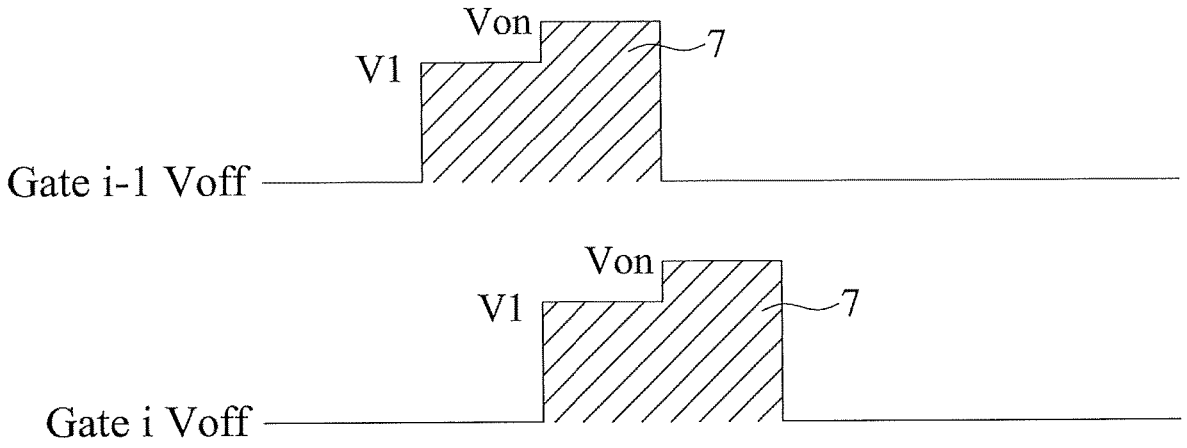
FIG. 4B illustrates the voltage measurement waveforms of the scan lines corresponding to the drive circuit of FIG. 4A.

FIG. 4B illustrates the voltage measurement waveforms of the scan lines corresponding to the drive circuit of FIG. 4A. It can be seen from the waveforms of the voltage values of the scan lines that when drive circuit scans the current scan line, the next scan line is pre-scanned and the scan voltage is the voltage value of the first level signal.

In the pixel array of the liquid crystal display panel, the gate drive signal functions as a switch. When the drive circuit outputs the gate drive signal, the pixel is charged by the source when the gate of the TFT in the pixel array is turned on. The actual brightness of the pixel is determined by the charge voltage and the charge time of the source, that is, it is determined by the area of the shaded portion 7 in FIG. 4B. The precharge effect is to increase the charge time. The scan lines Gate i−1 and Gate i have the same opening area although the opening times are different. Each pixel can get enough charge time to display pixel gray accurately under the situation that the scan time of each scan line is too short.

Figure 5:
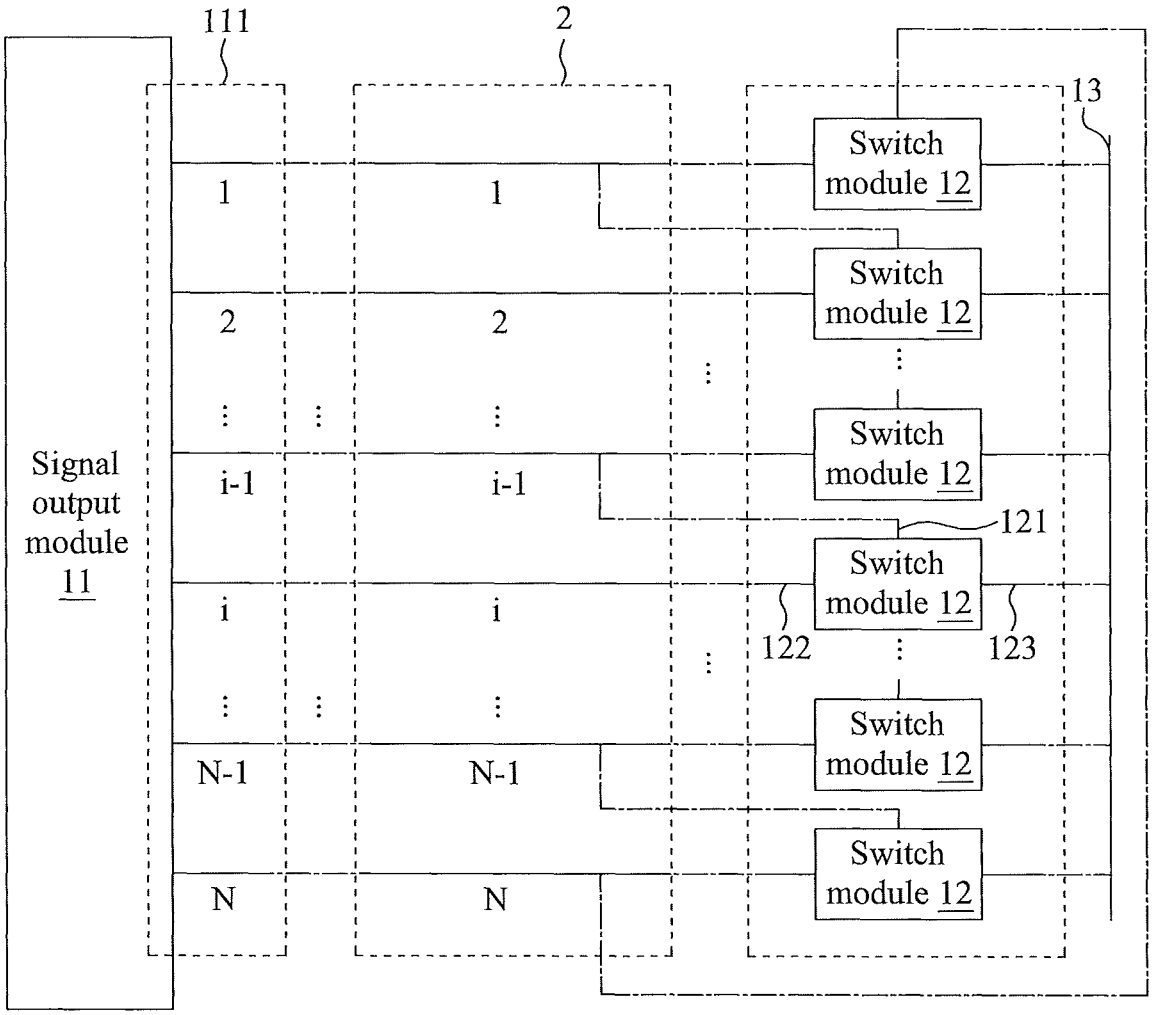
FIG. 5 is a schematic structural view of another drive circuit in accordance with an embodiment of the present invention.

Selectively, FIG. 5 is a schematic structural view of another drive circuit in accordance with an embodiment of the present invention. The switch modules 12 correspond in number to the scan lines 2. The first connecting end 122 of the first switch module 12 is electrically connected with the corresponding first scan line 2. The control end 121 is electrically connected with the last scan line 2. The second connecting end 123 is electrically connected with the first level signal output end 13 of the drive circuit.

There may be N switch modules 12 corresponding to N scan lines 2. When the drive circuit scans the last scan line 2 in one frame, the last scan line 2 turns on the first switch module 12 through the control end 121 of the first switch module 12. The first scan line 2 is electrically connected with the first level signal output end 13 to precharge the pixels of the first row so that the pixels of each row can be precharged to prevent the pixels from being insufficiently charged.

Alternatively, when the number of the switch modules 12 and the number of the scan lines 2 are the same, the first switch module 12 can be turned on by setting a suitable trigger signal, and the other switch module 12 can be turned on by the previous scan line 2. In this way, the pixels of each row also can be precharged.

In addition, the number of the switch module 12 and the number of the scan lines 2 may not be equal. As an example, for N scan lines 2, N−1 switch modules are provided corresponding to the second to N-th scan lines 2, respectively. It is possible to realize the precharge of the pixels of the second to N-th rows, which can solve the problems of insufficient charge and flickers. Alternatively, the number of switch modules 12 is less. The embodiments of the present invention don't limit the number of switch modules 12. However, the less the number of switch modules 12 is, the worse the technical effect is.

Figure 6:
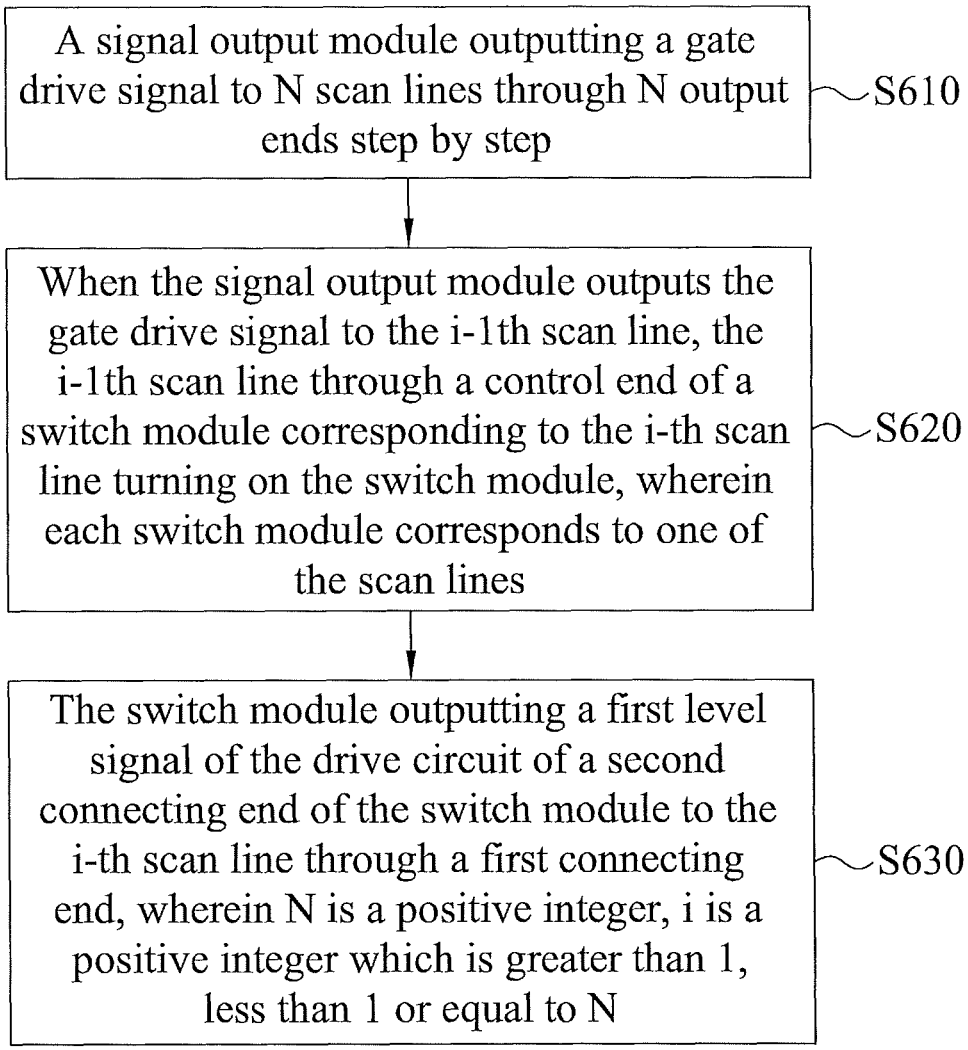
FIG. 6 is a flow chart of a drive method of a drive circuit in accordance with an embodiment of the present invention.

The embodiment of the present invention also provides a drive method of a drive circuit. The drive method is suitable for the drive circuit according to any one of the embodiments of the present invention. FIG. 6 is a flow chart of a drive method of a drive circuit in accordance with an embodiment of the present invention. The drive method includes the following steps of:

S610, a signal output module outputting a gate drive signal to N scan lines through N output ends step by step;

S620, when the signal output module outputs the gate drive signal to the i−1th scan line, the i−1th scan line through a control end of a switch module corresponding to the i-th scan line turning on the switch module, wherein each switch module corresponds to one of the scan lines;

S630, the switch module outputting a first level signal of the drive circuit of a second connecting end of the switch module to the i-th scan line through a first connecting end, wherein N is a positive integer, i is a positive integer which is greater than 1, less than 1 or equal to N.

According to the drive method of the drive circuit of the embodiment of the present invention, the drive circuit is provided with a plurality of switch modules on the basis of the signal output module. Each switch module corresponds to one of the scan lines for controlling the first level signal output end to be connected with or disconnected from the corresponding scan line. Each switch module is controlled to be turned on or off by the upper scan line. When the signal output module outputs the gate drive signal to the upper scan line, the TFTs of the upper row are turned on. When the data line charges up the pixels of the upper row, the current switch module is turned on so that the current scan line acquires the first level signal and the data line charges up the pixels of the current row. The drive method of the drive circuit of the embodiment of the present invention also charges the pixels of the next row when the pixels of a certain row are charged, so that a longer charge time is obtained for the pixels of each row to solve the problem that the pixels of the display panel are charged insufficiently to result in poor contrast images and flickers.

On the basis of the above embodiment, the switch module may be a thin film transistor.

Selectively, the switch module is an N-type thin film transistor. The voltage value of the gate drive signal is greater than the actuation voltage value of the control end of the N-type thin film transistor. The actuation voltage value of the control end of the N-type thin film transistor is greater than the voltage value of the first level signal.

Selectively, the switch module is an N-type metal-oxide semiconductor field-effect transistor.

Selectively, the signal output module is disposed on a gate-chip on film. The switch modules are disposed on a non-display area of an array substrate.

Selectively, the switch modules are disposed on the non-display area at the distal ends of the scan line, and the head ends of the scan line are electrically connected with the corresponding output ends of the signal output module.

Selectively, the number of switch modules and the number of the scan lines are the same, and both are a positive integer N.

When the signal output module scans the last scan line, the last scan line turns on the first switch module through the control end of the first switch module corresponding to the first scan line, and the first switch module transmits the first level signal of the second connecting end through the first connecting end to the first scan line so that the first scan line can be precharged.

Figure 7:
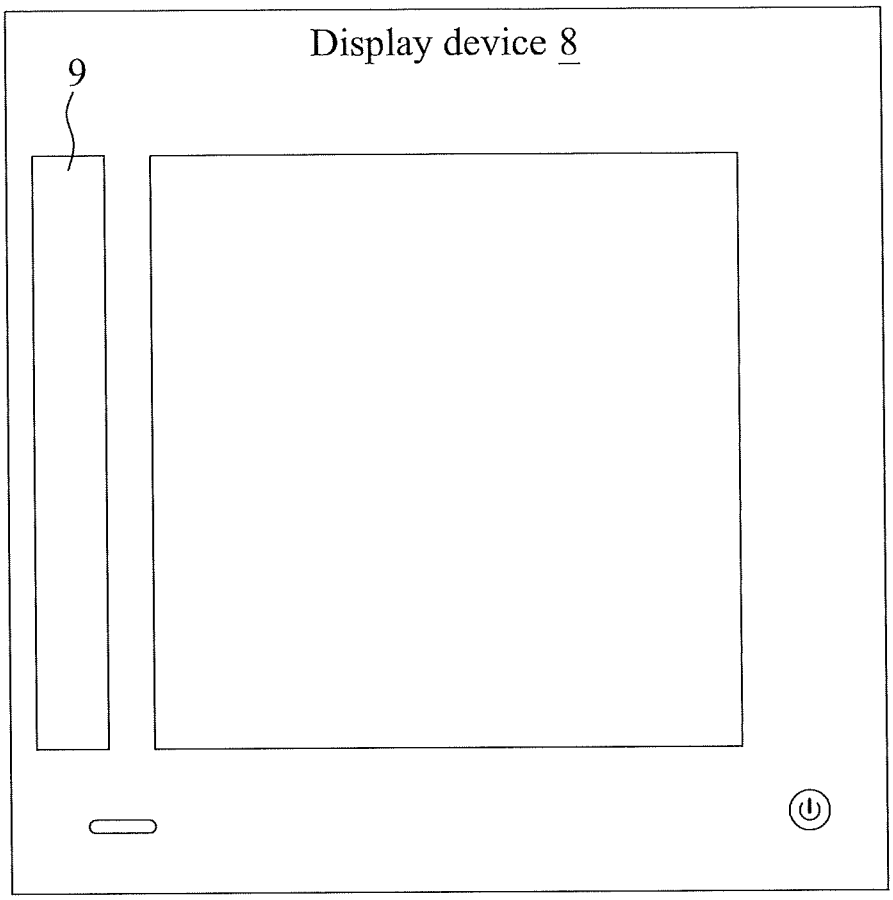
FIG. 7 is a schematic view of a display device in accordance with an embodiment of the present invention.

An embodiment of the present invention provides a display device. FIG. 7 is a schematic view of a display device in accordance with an embodiment of the present invention. The display device 8 includes a drive circuit 9 provided in any of the embodiments of the present invention.

Selectively, the display device 8 is a liquid crystal display device or an organic light emitting diode display device, or other display device having the drive circuit 9.

Alternatively, the display device 8 is a liquid crystal display device or an organic light emitting diode display device, or other display device having a driving circuit 9.

An embodiment of the present invention also provides another display device. The display device includes a plurality of display units, N scan lines, and M data lines. Each of the display units is set to an array of N rows and M columns. Each display unit includes a first thin film transistor. The first thin film transistor has a first threshold voltage. Each gate line is electrically connected with the gate of the first thin film transistor in a corresponding one of the N rows. Each data line is electrically connected with the source of the first thin film transistor in a corresponding one of the M columns.

Selectively, each display unit includes a pixel electrode. The pixel electrode is electrically connected with the drain of the first thin film transistor.

The display device further includes a gate drive signal output module, a first level signal line, and N second thin film transistors respectively corresponding to the N scan lines.

The gate drive signal output module has N output ends respectively corresponding to the N scan lines. Each output end is connected to a corresponding one of the scan lines. The N output ends sequentially provide gate drive signals to the N scan lines.

The first level signal line is configured to provide a first level signal. The first level signal is less than the first threshold voltage.

The second thin film transistor has a second threshold voltage. The gate drive signal is greater than the first threshold voltage and the second threshold voltage.

The gate of the i-th second thin film transistor is electrically connected with the i−1th scan line. The source of the i-th second thin film transistor is electrically connected with the first level signal line. The drain of the i-th second thin film transistor is electrically connected with the i-th scan line. Wherein, N and i are positive integers, $1<i\leq N$.

When the gate drive signal output module outputs the gate drive signal to the i−1th scan line, the second thin film transistor corresponding to the i-th scan line is turned on and the first level signal is transmitted to the i-th scan line.

Selectively, the first thin film transistors and the second thin film transistors are N-type thin film transistors.

Selectively, the voltage value of the first level signal is 80% of the voltage value of the gate drive signal.

Selectively, the first threshold voltage and the second threshold voltage are equal.

Selectively, the plurality of first thin film transistors are disposed on a display area of the display device. The N second thin film transistors are disposed on a non-display area of the display device.

Selectively, the display device further includes a gate-chip on film. The gate drive signal output module is disposed on the gate-chip on film.

The display device may be, for example, an LCD display device, an OLED display device, a QLED display device, a curved display device, or other display device.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A drive circuit, comprising:

a signal output module, comprising N output ends for outputting a gate drive signal step by step to N scan lines;

a first level signal output end; and a plurality of switch modules, the switch modules each corresponding to one of the scan lines, a control end of the i-th switch module being electrically connected with the i−1th scan line, a first connecting end being electrically connected with the corresponding i-th scan line, a second connecting end being electrically connected with the first level signal output end;

wherein, N is a positive integer, and i is a positive integer greater or less or equal to N;

wherein each of the switch modules is an N-type thin film transistor, a voltage value of the gate drive signal is greater than an actuation voltage value of a control end of the N-type thin film transistor, and the actuation voltage value of the control end of the N-type thin film transistor is 90% of the voltage value of the gate drive signal, and the voltage value of the first level signal output end is 80% of the voltage value of the gate drive signal.

2. The drive circuit as claimed in claim 1, wherein the switch modules are N-type metal-oxide semiconductor field-effect transistors.

3. The drive circuit as claimed in claim 1, wherein the signal output module is disposed on a gate-chip on film, and the plurality of switch modules are disposed on a non-display area of an array substrate.

4. The drive circuit as claimed in claim 3, wherein first ends of the scan lines are electrically connected with the corresponding output ends of the signal output module respectively, and the switch modules are disposed on the non-display area at second ends of the scan lines.

5. The drive circuit as claimed in claim 1, wherein the switch modules correspond in number to the scan lines;

the first connecting end of the first switch module is electrically connected with the first one of the scan lines, the control end is electrically connected with the last one of the scan lines, and the second connecting end is electrically connected with the first level signal output end.

6. A display device, comprising a display panel and the drive circuit as claimed in claim 1.

7. The display device as claimed in claim 6, wherein the signal output module is disposed on a gate-chip on film, and the plurality of switch modules are disposed on a non-display area of an array substrate.

8. A drive method for driving the drive circuit as claimed in claim 1, comprising the following steps of:

the signal output module outputting the gate drive signal to the N scan lines through the N output ends step by step;

wherein, when the signal output module outputs the gate drive signal to the i−1th scan line, the i−1th scan line enables the switch module corresponding to the i-th scan line to be turned on, and a first level signal is transmitted to the i-th scan line through the switch module, wherein N is a positive integer, and i is a positive integer greater than 1, less than 1 or equal to N.

9. A display device, comprising:

N scan lines, each scan line being connected with a plurality of first thin film transistors, the first thin film transistors having a first threshold voltage;

a gate drive signal output module, having N output ends respectively corresponding to the N scan lines, each output end being connected to a corresponding one of the scan lines, the N output ends sequentially providing a gate drive signal to the N scan lines;

a first level signal line being configured to provide a first level signal, the first level signal being less than the first threshold voltage;

N second thin film transistors respectively corresponding to the N scan lines, the second thin film transistors having a second threshold voltage;

wherein, a gate of the i-th second thin film transistor is electrically connected with the i−1th scan line, a source of the i-th second thin film transistor is electrically connected with the first level signal line, a drain of the i-th second thin film transistor is electrically connected with the corresponding scan line, N and i are positive integers, $1<i\leq N$;

wherein the gate drive signal is greater than the first threshold voltage and the second threshold voltage;

wherein a voltage value of the first level signal is 80% of a voltage value of the gate drive signal, and a voltage value of an actuation voltage value of a control end of one of the plurality of first thin film transistors is 90% of the voltage value of the gate drive signal.

10. The display device as claimed in claim 9, wherein the first thin film transistors and the second thin film transistors are N-type thin film transistors.

11. The display device as claimed in claim 9, wherein the plurality of first thin film transistors are disposed on a display area of the display device, and the N second thin film transistors are disposed on a non-display area of the display device.

12. The display device as claimed in claim 9, wherein further comprising a gate-chip on film, the gate drive signal output module being disposed on the gate-chip on film.

* * * * *